US012281824B2

(12) United States Patent
Hagh et al.

(10) Patent No.: US 12,281,824 B2
(45) Date of Patent: Apr. 22, 2025

(54) VAPOR CYCLE COOLING SYSTEM FOR HIGH POWERED DEVICES

(71) Applicant: Honeywell International Inc., Charlotte, NC (US)

(72) Inventors: Bijan F. Hagh, Newport Beach, CA (US); Joseph Borghese, Yucca Valley, CA (US)

(73) Assignee: Honeywell International Inc., Charlotte, NC (US)

( * ) Notice: Subject to any disclaimer, the term of this patent is extended or adjusted under 35 U.S.C. 154(b) by 392 days.

(21) Appl. No.: 17/805,367

(22) Filed: Jun. 3, 2022

(65) Prior Publication Data

US 2023/0392840 A1 Dec. 7, 2023

(51) Int. Cl.

| | |
|---|---|
| ***F25B 40/00*** | (2006.01) |
| ***F25B 19/00*** | (2006.01) |
| ***F25B 43/04*** | (2006.01) |

(52) U.S. Cl.

CPC ..... *F25B 43/043* (2013.01); *F25B 19/00* (2013.01); *F25B 40/00* (2013.01); *F25B 2400/23* (2013.01)

(58) Field of Classification Search

CPC ..... F25B 43/043; F25B 43/006; F25B 19/00; F25B 40/00; F25B 40/02; F25B 2400/23

See application file for complete search history.

(56) References Cited

U.S. PATENT DOCUMENTS

| | | | | |
|---|---|---|---|---|
| 4,679,410 | A * | 7/1987 | Drayer | B60H 1/00335 62/503 |
| 5,007,247 | A * | 4/1991 | Danig | F25B 43/006 62/174 |
| 7,356,998 | B2 | 4/2008 | Lee et al. | |
| 7,644,593 | B2 | 1/2010 | Duraisamy | |
| 8,959,937 | B2 | 2/2015 | Piesker | |
| 9,797,637 | B2 | 10/2017 | Shimazu | |
| 10,907,869 | B2 | 2/2021 | Hagh et al. | |

(Continued)

FOREIGN PATENT DOCUMENTS

| | | |
|---|---|---|
| CN | 109682135 A | 4/2019 |
| JP | 2015172469 A | 10/2015 |

(Continued)

OTHER PUBLICATIONS

Advanced Cooling Technologies, Inc. et al., "Pumped Two Phase Cooling Solutions for Challenging Thermal Management Applications", Thermal News, Jan. 19, 2015, 3 pp.

(Continued)

*Primary Examiner* — Miguel A Diaz

(74) *Attorney, Agent, or Firm* — Shumaker & Sieffert, P.A.

(57) ABSTRACT

An example flash tank includes a first inlet configured to receive a superheated vapor refrigerant, a second inlet configured to receive a two-phase refrigerant, a vapor outlet, a liquid collection volume, and a phase separation matrix including a first fluid path fluidically coupled between the first inlet and the liquid collection volume, a second fluid path fluidically coupled between the second inlet and the liquid collection volume, and a third fluid path fluidically coupled between the vapor outlet and the liquid collection volume. The phase separation matrix is configured to radially distribute thermal mixing of a refrigerant flowing within the first, second, and third fluid paths.

18 Claims, 3 Drawing Sheets

(56) References Cited

U.S. PATENT DOCUMENTS

| | | | | |
|---|---|---|---|---|
| 2008/0236179 | A1 | 10/2008 | Ignatiev et al. | |
| 2009/0025405 | A1 | 1/2009 | Yanik | |
| 2011/0174014 | A1 | 7/2011 | Scarcella et al. | |
| 2012/0103005 | A1 | 5/2012 | Kopko et al. | |
| 2013/0025305 | A1* | 1/2013 | Higashiiue ..... | F25B 41/00 62/115 |
| 2014/0013782 | A1 | 1/2014 | Kopko et al. | |

FOREIGN PATENT DOCUMENTS

| | | | |
|---|---|---|---|
| JP | 2019155279 | A | 9/2019 |
| JP | 6670196 | B2 | 3/2020 |

OTHER PUBLICATIONS

Wu et al., "Experimental Evaluation and Control of Two-Phase Multi-Microchannel Evaporator Cooling Systems for High Efficiency Data Center", These No. 5588, 2012, 248 pp., (Applicant points out, in accordance with MPEP 609.04 (a), that the year of publication, 2012, is sufficiently earlier than the effective U.S. filing date, so that the particular month of publication is not in issue.).

* cited by examiner

VAPOR CYCLE COOLING SYSTEM FOR HIGH POWERED DEVICES

TECHNICAL FIELD

The disclosure relates to vapor cycle cooling.

BACKGROUND

A vapor cycle cooling system cools a device and/or components of a device. A vapor cooling system compresses and condenses a refrigerant from a relatively low-pressure vapor to a relatively high-pressure liquid, which then expands and evaporates to remove heat from a target fluid stream.

SUMMARY

In one example, this disclosure describes a flash tank including: a first inlet configured to receive a superheated vapor refrigerant; a second inlet configured to receive a two-phase refrigerant; a vapor outlet; a liquid collection volume; a phase separation matrix including: a first fluid path fluidically coupled between the first inlet and the liquid collection volume; a second fluid path fluidically coupled between the second inlet and the liquid collection volume; and a third fluid path fluidically coupled between the vapor outlet and the liquid collection volume, wherein the phase separation matrix is configured to radially distribute thermal mixing of a refrigerant flowing within the first, second, and third fluid paths.

In another example, this disclosure describes a system including: a subcooler/super-heater; and a flash tank including: an inlet configured to receive a superheated vapor refrigerant and a two-phase refrigerant; a vapor outlet; a liquid collection volume; a phase separation matrix disposed between the vapor outlet and the liquid collection volume, wherein the inlet is fluidically coupled to the liquid collection volume, wherein the phase separation matrix is configured to separate a vapor phase and a liquid phase of both the superheated vapor refrigerant and the two-phase refrigerant, wherein the subcooler/super-heater is fluidically coupled the vapor outlet.

In another example, this disclosure describes a system including: a flash tank downstream of a heat load to be cooled, the flash tank including: an inlet configured to receive a superheated vapor refrigerant and a two-phase refrigerant; a vapor outlet; a liquid collection volume; a phase separation matrix disposed between the vapor outlet and the liquid collection volume, wherein the phase separation matrix is configured to separate a vapor phase and a liquid phase of both the superheated vapor refrigerant and the two-phase refrigerant; within the first, second, and third fluid paths; a subcooler/super-heater downstream of the flash tank; a compressor downstream of the subcooler/super-heater; a condenser downstream of the compressor and upstream of the flash tank; an expansion valve intermediate the flash tank and the subcooler/super-heater, the expansion valve configured to discharge a mixture of vapor and liquid refrigerant to the subcooler/super-heater.

The details of one or more examples are set forth in the accompanying drawings and the description below. Other features, objects, and advantages will be apparent from the description and drawings, and from the claims.

DETAILED DESCRIPTION

Figure 1:
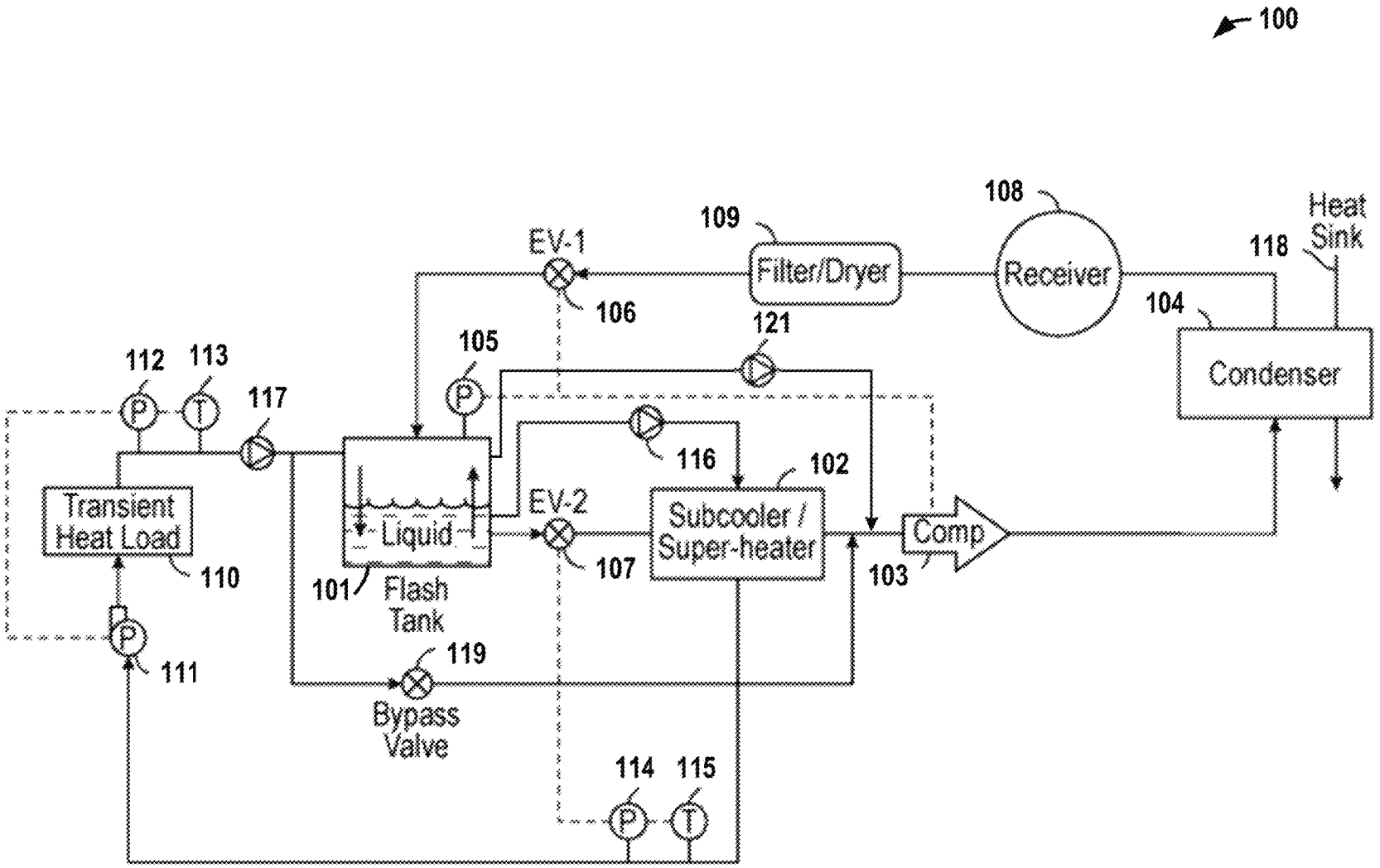
FIG. 1 is a block diagram illustrating an example system for cooling a device that includes a vapor-compression system (VCS).

The disclosure describes systems and techniques for separating phases of, and storing heat in, a two-phase refrigerant using a flash tank. For example, thermal management for transient or cyclical heat loads, such as laser diodes, involves accommodating large heat fluxes within narrow temperature limits. Cooling systems for such transient or cyclical heat loads usually require thermal lift to a heat sink at a higher ambient temperature, which can be achieved with a vapor cycle system (VCS) using refrigerants. The size of the VCS can be reduced by incorporating means for thermal storage, which may buffer transient heat loads by spreading cooling over a period of time and accommodating changes in pressure of the refrigerant. Further weight reduction of the VCS can be achieved by using a pumped two-phase cooling system with a high efficiency centrifugal pump for supplying refrigerant to a heat load. However, such a pump may require substantial subcooling (e.g., about 20° F.) to prevent cavitation. Additionally, a compressor of the VCS may require substantial superheating to prevent vapor impingement or maintain efficiency.

In accordance with the systems and techniques disclosed herein, a thermal management system includes a flash tank configured to separate liquid and vapor phases of a two-phase refrigerant, e.g., via transfer of heat to the vapor phase refrigerant and utilizing the latent heat of the liquid phase refrigerant for thermal storage. The flash tank receives refrigerant from one or more fluid inlet streams and discharges refrigerant to one or more fluid outlet streams. The one or more fluid inlet streams may include refrigerant having various temperatures and qualities, such as any combination of a superheated vapor phase, a subcooled liquid phase, and mixed vapor and liquid phases. The flash tank is configured to maintain a liquid phase of the refrigerant responsive to a pressure of the refrigerant. For example, a level of the liquid phase refrigerant may decrease as a pressure of the refrigerant increases (e.g., heat load exceeding cooling), increase as the pressure of the refrigerant decreases (e.g., cooling exceeding head load), and remain constant as the pressure remains constant (e.g., cooling balanced with heat load). In this way, the flash tank may accommodate a transient or cyclical heat load. The one or more outlet fluid streams may be a liquid fluid and a vapor fluid, e.g., a liquid refrigerant and a vapor refrigerant.

In addition to providing thermal storage, the flash tank is configured to transfer heat between the fluid inlet streams and one or more vapor phase outlet streams to further separate the liquid phase refrigerant from the vapor phase refrigerant and reduce an amount of downstream subcooling of the liquid phase and/or superheating of the vapor phase discharged from the flash tank. The flash tank includes a phase separation matrix configured to separate a vapor phase and a liquid phase of both a superheated vapor refrigerant and a two-phase refrigerant. Rather than directly receive the fluid inlet streams into, and discharge the vapor outlet streams from, a cavity of the flash tank, the flash tank includes the phase separation matrix to receive the fluid inlet streams and provide a thermal interface for transferring heat between the fluid inlet streams and the vapor phase outlet streams and removing entrained liquid phase refrigerant from the vapor outlet streams. In some examples, the phase separation matrix includes a plurality of fluid paths between the fluid inlet streams and the vapor outlet streams. In some examples, each of the plurality of fluid paths are configured to radially distribute thermal mixing of the refrigerant flowing within the plurality of flow paths. For example, the phase separation matrix may comprise a thermally conductive material configured to physically separate each of the fluid paths while allowing the fluids to transfer thermal energy without physically mixing, and to radially distribute the fluids flowing in the plurality of flow paths.

In some examples, the phase separation matrix may be a gyroid or other matrix structure having two or more fluid paths separated by a thermal interface. For example, for a vapor cycle system, the gyroid may include a first path fluidically coupled between the liquid collection volume of the flash tank and a superheated refrigerant inlet, a second path fluidically coupled between the liquid collection volume of the flash tank and a two-phase refrigerant inlet, and a third path fluidically coupled between the liquid collection volume of the flash tank and a vapor outlet of the flash tank. Each of the three paths cause the fluid within the respective paths to be distributed radially as the fluid traverses the path from their respective inlets to their respective outlets, and the fluids, although physically separated, have an increased "mixing" with respect to thermal transfer by virtue of shared path walls that distribute the fluids both longitudinally and radially within at least a portion of the volume of the flash tank. In other examples, the phase separation matrix comprises a plurality of stacked fins comprising a thermally conductive material.

In examples described herein, a thermal management system that includes a flash tank that can be incorporated into a VCS. For example, the flash tank may include a phase separation matrix configured to receive a superheated vapor phase refrigerant from a heat load and two-phase refrigerant from a condenser and/or expansion valve, and discharge. If heating from the heat load and cooling from the VCS are balanced, the pressure and level of liquid phase refrigerant in the flash tank may remain constant. If heating exceeds cooling, the pressure may rise and level of liquid phase refrigerant may drop with time. If cooling is higher than heating, the pressure may decrease and level of liquid phase refrigerant may increase with time. A variable speed pump feeds subcooled liquid-phase refrigerant to the evaporator of the heat load to ensure adequate heat removal at the evaporator with some superheat at the outlet discharged into the flash tank. The flash tank may discharge a liquid phase refrigerant from the liquid phase outlet to the variable pump via a heat exchanger and discharge a vapor phase refrigerant from the vapor phase outlet to the compressor via the heat exchanger. A portion of the liquid phase refrigerant may be expanded to provide subcooling to the liquid phase refrigerant. As a result, the VCS may be substantially lighter and smaller (e.g., about 40% lighter and/or smaller) and have substantially faster start-up time (e.g., about six times faster) than a conventional cooling systems for transient and cyclical heat loads.

FIG. 1 is a schematic diagram of a thermal management (i.e., cooling) system 100 according to an exemplary embodiment of the present invention. System 100 may be configured to remove heat from a transient and/or cyclical heat load 110. Transient and/or cyclical heat load 110 may include any heat load that varies over time, such that a variable amount of heat may be removed by system 110. Example transient and/or cyclical heat loads may include, but are not limited to, electronics, lasers, or any heat load and/or heat load type that may undergo fluctuations in heat output over a period of time.

The system 100 may include a flash tank 101 that is configured to receive, hold, and discharge a refrigerant at various phases, such as a liquid refrigerant, a vapor refrigerant, and/or a liquid-vapor refrigerant. Flash tank 101 may be directly or indirectly (e.g., via check valve 117) downstream of a transient and/or cyclical heat load 110 (e.g., electronics, lasers, or any heat load and/or heat load type) to be cooled by system 100. A pressure sensor 112 and a temperature sensor 113 may be positioned between flash tank 101 and heat load 110, and may provide an indication of a pressure and temperature of a vapor refrigerant discharged from heat load 110 for use by a VCS controller to adjust operation of a variable speed pump 111, such as to ensure adequate heat removal from heat load 110 and at least some degree of superheat of vapor refrigerant at the outlet of the heat load 110.

Flash tank 101 may be configured to store heat from heat load 110 in a liquid refrigerant. For example, system 100 may be generally configured to remove heat from heat load 110 across an operating envelope. In a conventional VCS without flash tank 101, system 100 may be sized for a maximum amount of heat produced by heat load 110. However, for a transient or cyclic heat load 110, such a VCS may be oversized during low heat output from heat load 110. Flash tank 101 may enable system 100 to spread heat removed from heat load 110 over a larger period of time, such that various VCS components fluidically coupled to flash tank 110 may remove a less variable amount of heat. As such, flash tank 101 may be sized to accommodate surges in heat output by heat load 110, such that an overall weight of system 100 may be reduced.

Flash tank 101 may be configured to discharge vapor refrigerant to a compressor 103 and liquid refrigerant to heat source 110 via pump 111. System 100 may include a subcooler/super-heater 102 and an expansion valve (EV-2) 107 positioned downstream of flash tank 101 and upstream of pump 111 to subcool the liquid refrigerant. Expansion valve 107 may be positioned between flash tank 101 and subcooler/super-heater 102 and configured to reduce a pressure of at least a portion of the liquid refrigerant from flash tank 101 to flash the portion of the liquid refrigerant and discharge a mixture of vapor and liquid refrigerant at lower pressure to the subcooler/super-heater 102. The subcooler/super-heater 102 may be indirectly downstream of the flash tank 101 via a check valve 116 and configured to cool a remaining portion of the liquid refrigerant from flash tank 101 using the flashed refrigerant, as well as heat the flashed refrigerant from flash tank 101 via an expansion valve (EV-2) 107.

Compressor 103 may be positioned directly or indirectly (e.g., via subcooler/super-heater 102 and/or check valve 121) downstream of flash tank 101. Compressor 103 may be configured to receive saturated or superheated vapor refrigerant from flash tank 101 and superheated vapor from subcooler/super-heater 102. In some examples, system 100 may include bypass valve 119 to inject high pressure refrigerant from the outlet of transient and/or cyclical heat load 110. This may permit higher load capability and superheating at a compressor 103 inlet independent of an EV-2 expansion valve 107 opening. For example, superheat may be provided to measure the fluid state of the refrigerant for control purposes. A pressure sensor 105 may be configured to measure pressure in the flash tank 101. Pressure sensor 105 may be used to control compressor 103 and/or EV-1 expansion valve 106 to maintain pressure in the flash tank 101 within acceptable limits.

A condenser 104 may be directly downstream of the compressor 103 and configured to receive and condense vapor refrigerant from compressor 103 and discharge a sub-cooled liquid refrigerant by placing the vapor refrigerant in heat exchange with a heat sink 118, such as a fan air or water. A receiver 108 may be directly downstream of the condenser 104 and configured to store liquid refrigerant. A filter/dryer 109 may be directly downstream of the receiver 108 and may be configured to remove debris and humidity from the liquid refrigerant. An expansion valve (EV-1) 106 may be directly downstream of the filter/dryer 109 and configured to discharge a mixture of vapor and liquid refrigerant at lower pressure to the flash tank 101.

As noted above, liquid refrigerant from flash tank 101 may flow to a downstream pump 111. In examples that include subcooler/super-heater 102 and expansion valve 107, a pressure sensor 114 and a temperature sensor 115 upstream of pump 111 may be used to control EV-2 expansion valve 107 to ensure adequate subcooling at inlet of the pump 111.

In some examples, flash tank 101 is configured to separate a vapor phase and a liquid phase of both the superheated vapor refrigerant and the two-phase refrigerant, e.g., in addition to providing thermal storage for system 100 via the refrigerant. For example, flash tank 101 may include a phase separation matrix configured to separate the vapor and liquid phases of refrigerant received within flash tank 101 via one or more inlets, and to allow the liquid phase of the received and/or separated refrigerant to flow to a liquid collection volume within flash tank 101 and the vapor phase of the received and/or separated refrigerant to flow to a vapor outlet of flash tank 101. In some examples, the phase separation matrix may allow the received superheated vapor refrigerant to mix with the received two-phase refrigerant during phase separation. For example, the phase separation matrix may comprise a plurality of stacked fins of a thermally conductive material. In other examples, the phase separation matrix may separate the received superheated vapor refrigerant from the received two-phase refrigerant into different inlet streams and/or flow paths. For example, phase separation matrix may comprise a gyroid comprising a thermally conductive material, and flash tank 101 may include a plurality of inlets with each inlet fluidically coupled to a flow path with the gyroid. The gyroid may be configured to radially distribute thermal mixing of the received refrigerant (e.g., superheated vapor refrigerant, two-phase refrigerant, or refrigerant in any suitable form) flowing within the plurality of flow paths, e.g., via the thermally conductive material and without allowing the fluids within the flow paths to physically mix.

Figure 2:
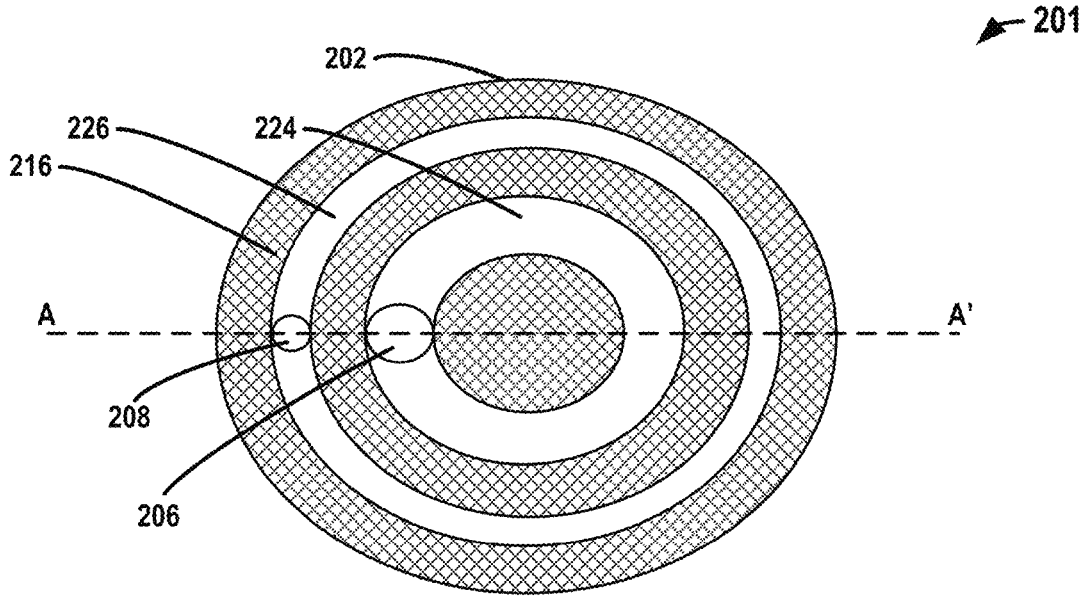
FIG. 2 is a cross-sectional top view of an example flash tank.
Figure 3:
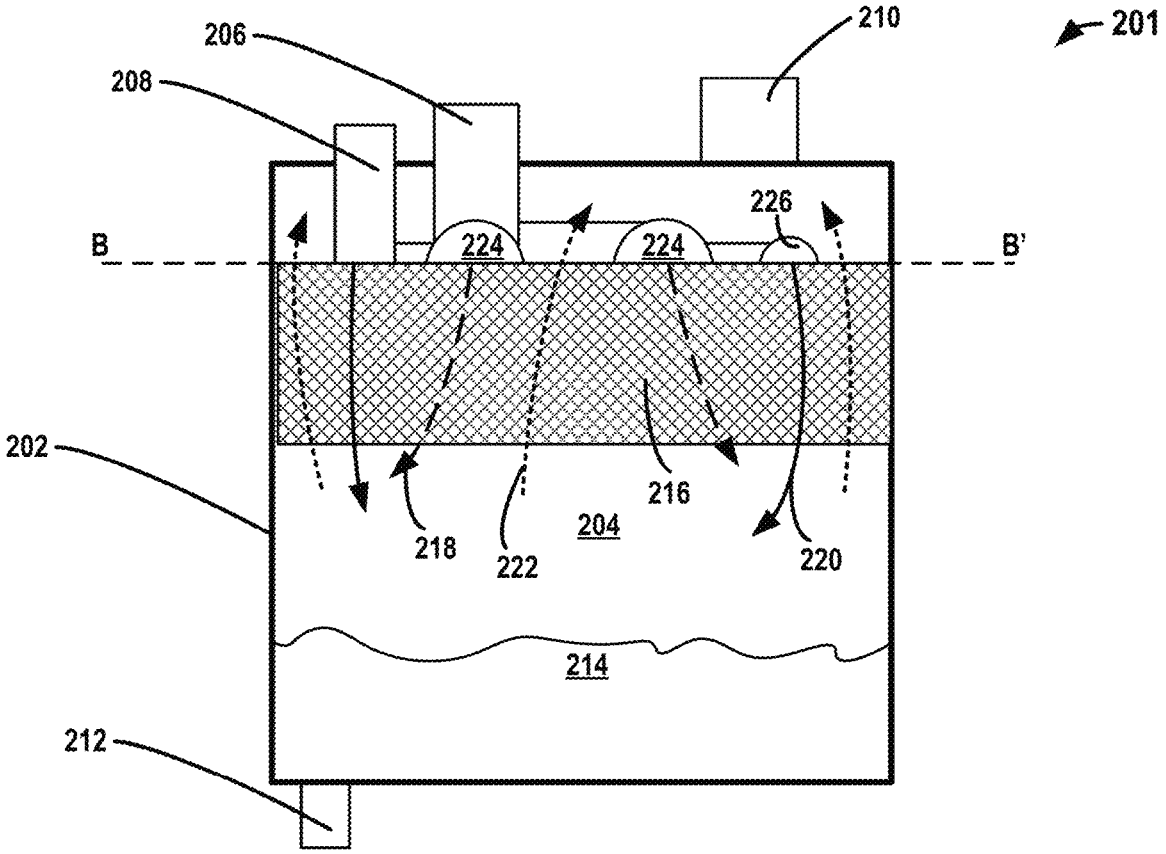
FIG. 3 is a cross-sectional side view of the example flash tank of FIG. 2.
Figure 5:
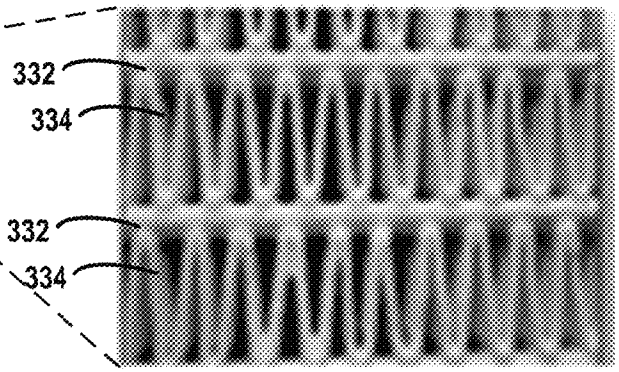
FIG. 5 is an exploded view of a cross-sectional side view of an example phase separation matrix.

FIG. 2 is a cross-sectional top view of an example flash tank 201, and FIG. 3 is a cross-sectional side view of the example flash tank 201. In the examples shown, FIG. 3 is a cross-section of flash tank 201 taken along that line A-A' shown in FIG. 2, and FIG. 2 is a cross-section of flash tank 201 taken along the line B-B' shown in FIG. 3.

Flash tank 201 comprises housing 202 defining volume 204. Housing 202 includes fluid inlets 206 and 208 and fluid outlets 210 and 212. Fluid inlet 206 is configured to receive a superheated vapor refrigerant, e.g., from thermal load 110 (FIG. 1). Fluid inlet 208 is configured to receive a two-phase refrigerant, e.g., from expansion valve 106 (EV-1 of FIG. 1). Fluid outlet 210 may be a vapor outlet, and is referred to herein as vapor outlet 210. Vapor outlet 210 may be configured to allow vapor refrigerant to exit flash tank 201. Vapor outlet 210 may be fluidically coupled to a compressor, such as compressor 103 of FIG. 1. For example, vapor outlet 210 may be directly coupled to compressor 103. Fluid outlet 212 may be configured to allow liquid refrigerant to exit flash tank 201, and may be fluidically coupled to pump 111, either directly or indirectly via subcooler/super-heater 102 and expansion valve 107 (FIG. 1).

In the example shown, flash tank 201 includes liquid collection volume 214, which may be a portion of volume 204 defined by housing 202. Liquid collection volume 214 is configured to receive liquid refrigerant and allow the liquid refrigerant to collect within flash tank 201, e.g., via gravity and/or a pressure difference between inlets 206 and 208 and liquid collection volume 214.

In the example shown, flash tank 201 includes phase separation matrix 216. Phase separation matrix 216 is configured to separate a vapor phase and a liquid phase of both the superheated vapor refrigerant received via inlet 206 and the two-phase refrigerant received via inlet 208. For example, phase separation matrix 216 may be formed of a thermally conductive material, e.g., copper, aluminum, steel, any suitable metal, or the like. The superheated vapor refrigerant and two-phase refrigerant may transfer heat via contact with the thermally conductive material of phase separation matrix 216, e.g., a portion of the refrigerant may condense and a portion of the refrigerant may vaporize. For example, phase separation matrix 216 may be configured to remove liquid in vapor refrigerant flowing to vapor outlet 210, and phase separation matrix 216 may be configured to allow the removed liquid to flow to liquid collection volume 214. In other words, phase separation matrix 216 is configured to allow the vapor phase refrigerant to flow to vapor outlet 210 and to allow the liquid phase refrigerant to flow to liquid collection volume 214.

In the example shown, phase separation matrix 216 may comprise a plurality of flow paths, which may physically separate a plurality of fluid streams and prevent each of the plurality of fluid streams from physically mixing, but allowing each of the fluid streams to transfer thermal energy between each other, e.g., via the thermally conductive material. For example, the thermally conductive material of phase separation matrix 216 may be formed into a plurality of flow paths, or "fluid paths," with each fluid path configured to allow a fluid to flow from an inlet to an outlet. In the example shown, phase separation matrix 216 may comprise a first fluid path 218 coupled between inlet 206 and liquid collection volume 214, a second fluid path 220 fluidically coupled between the inlet 208 and liquid collection volume 214, and a third fluid path 222 fluidically coupled between vapor outlet 210 and liquid collection volume 214.

In some examples, phase separation matrix 216 may be configured to radially distribute thermal mixing of a refrigerant flowing within the plurality of flow paths. For example, separation matrix 216 may be a gyroid, e.g., the thermally conductive material may be formed into a gyroid structure including fluid paths 218, 220, and 222. The gyroid structure of phase separation matrix 216 may be configured to radially distribute thermal mixing of refrigerant (vapor, liquid, or two-phase) flowing within each of the fluid paths 218, 220, 222, e.g., via the thermally conductive material forming the gyroid structure.

In some examples, flash tank 201 may include one or more distribution manifolds configured to distribute refrigerant received by an inlet to phase separation matrix 216. In the example shown, flash tank 201 includes distribution manifold 224 configured to radially distribute the superheated vapor refrigerant from inlet 206 to the fluid path 218 of phase separation matrix 216 and distribution manifold 226 configured to radially distribute the two-phase refrigerant from inlet 208 to fluid path 220.

In some examples, flash tank 201 is configured to have a greater pressure drop from inlets 206, 208 to liquid collection volume 214 than a pressure drop from liquid collection volume 214 to vapor outlet 210. For example, flash tank 201 and/or system 100 may be configured to have and/or cause a first pressure at inlet 206 that is greater than a pressure of liquid collection volume 214, a second pressure at inlet 208 that is greater than the pressure of liquid collection volume 214, and a third pressure at the vapor outlet 210 that is less than the pressure of the liquid collection volume 214. In some examples, an inlet pressure drop, e.g., a difference between one or both of the pressure at inlet 206 and the pressure at inlet 208 and the pressure of the liquid collection volume 214, is greater than an outlet pressure drop, e.g., a difference between the pressure at liquid collection volume 214 and vapor outlet 210. In other words, flash tank 201 and/or system 100 may be configured such that a difference in pressure between vapor outlet 210 and liquid collection volume 214 is less than one, or both, of a difference in pressure between inlet 206 and liquid collection volume 214 and a difference in pressure between the inlet 208 and liquid collection volume 214. In some examples, phase separation matrix 216 may comprise fluid path 222 (e.g., the fluid path from liquid collection volume 214 to vapor outlet 210) having a greater flow volume than one, or both, of fluid paths 218 and 220. For example, phase separation matrix 216 may be a gyroid with a fluid flow path 222 comprising a greater volume and/or void fraction of the gyroid than one or both of fluid flow paths 218 and 220.

Figure 4:
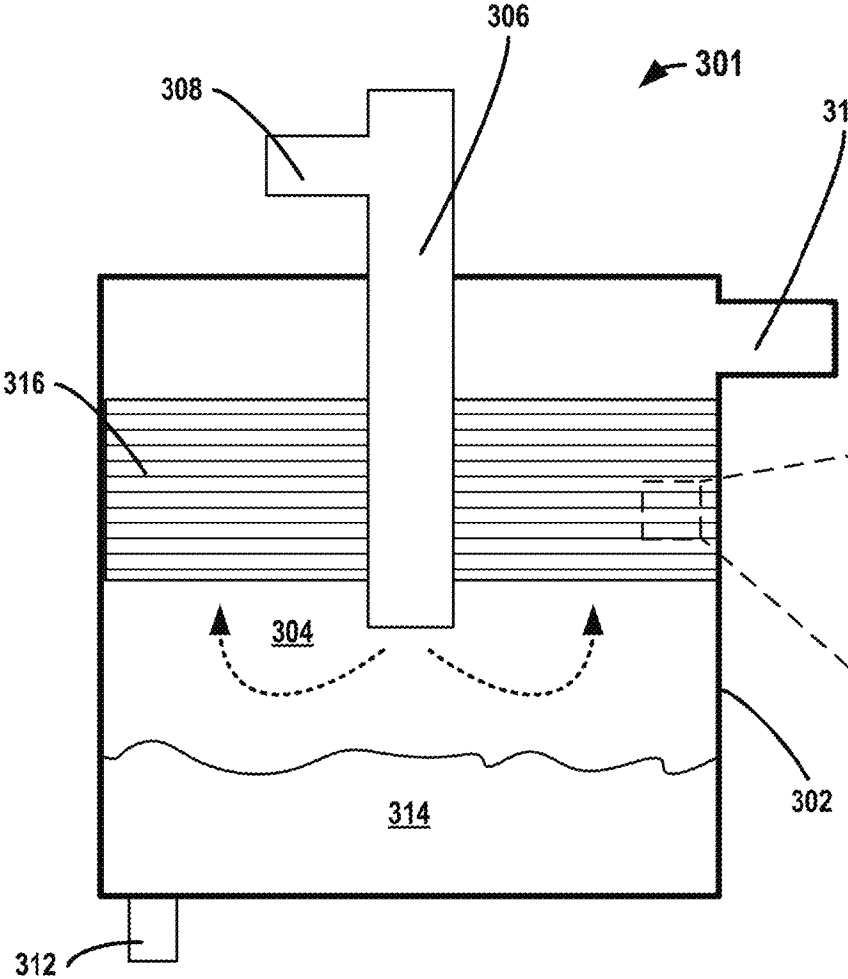
FIG. 4 is a cross-sectional side view of another example flash tank.

FIG. 4 is a cross-sectional side view of another example flash tank 301, and FIG. is an exploded view of a cross-sectional side view of an example phase separation matrix 316 useable with flash tank 301.

Flash tank 301 comprises housing 302 defining volume 304. Housing 302 includes fluid inlets 306 and 308 and fluid outlets 310 and 312. Fluid inlet 306 is configured to receive a superheated vapor refrigerant, e.g., from thermal load 110 (FIG. 1). Fluid inlet 308 is configured to receive a two-phase refrigerant, e.g., from expansion valve 106 (EV-1 of FIG. 1). Fluid inlet 306 is also fluidically coupled to fluid inlet 308, e.g., fluid inlet 306 is configured to receive and/or mix both the superheated vapor refrigerant and two-phase refrigerant, e.g., via inlet 308, and introduce the superheated vapor refrigerant and two-phase refrigerant into volume 304. Fluid outlet 310 may be a vapor outlet, and is referred to herein as vapor outlet 310. Vapor outlet 310 may be configured to allow vapor refrigerant to exit flash tank 301, and may be substantially similar to vapor outlet 210 described above. Vapor outlet 310 may be configured to be fluidically coupled to compressor 103. Fluid outlet 312 may be configured to allow liquid refrigerant to exit flash tank 301, and may be fluidically coupled to subcooler/super-heater 102 via expansion valve 107 (FIG. 1), and may be substantially similar to fluid outlet 212 described above.

In the example shown, flash tank 301 includes liquid collection volume 314, which may be a portion of volume 304 defined by housing 302. Liquid collection volume 314 is configured to receive liquid refrigerant and allow the liquid refrigerant to collect within flash tank 301, e.g., via gravity and/or a pressure difference between inlet 306 and liquid collection volume 314.

In the example shown, flash tank 301 includes phase separation matrix 316. Phase separation matrix 316 is configured to separate a vapor phase and a liquid phase of both the superheated vapor refrigerant and the two-phase refrigerant received via inlet 306. For example, phase separation matrix 316 may be formed of a thermally conductive material, e.g., copper, aluminum, steel, any suitable metal, or the like. The superheated vapor refrigerant and two-phase refrigerant may transfer heat via contact with the thermally conductive material of phase separation matrix 316, e.g., a portion of the refrigerant may condense and a portion of the refrigerant may vaporize. For example, phase separation matrix 316 may be configured to remove liquid in vapor refrigerant flowing to vapor outlet 310, and phase separation matrix 316 may be configured to allow the removed liquid to flow to liquid collection volume 314. In other words, phase separation matrix 316 is configured to allow the vapor phase refrigerant to flow to vapor outlet 310 and to allow the liquid phase refrigerant to flow to liquid collection volume 314.

In some examples, phase separation matrix 316 may comprise a plurality of stacked fins. For example, the thermally conductive material of phase separation matrix 316 may be formed into a plurality of stacked fins, and in some examples, may be formed into a plurality of stacked fins including alternating flat plates and fins brazed together, e.g., as a block. In the example shown, phase separation matrix 316 includes a plurality of flat plates 332 and wavy fins 334 stacked as a plurality of blocks 336. In some examples, phase separation matrix 316 provides a large surface area for phase separation and heat transfer. In some examples, the plurality of stacked fins may be plain fins (e.g., substantially planar fins), wavy fins, offset fins, or the like. In some examples, flash tank 310 may include one or more baffles configured to distribute refrigerant flow, e.g., the plurality of stacked fins of phase separation matrix 316 may be configured to remove liquid from vapor refrigerant flowing from liquid collection volume 314 to vapor outlet 310 and one or more baffles may be configured to distribute the flow of the vapor refrigerant through volume 304 and/or phase separation matrix 316.

The following numbered examples illustrate one or more aspects of the devices and techniques described in this disclosure.

Example 1: A flash tank including: a first inlet configured to receive a superheated vapor refrigerant; a second inlet configured to receive a two-phase refrigerant; a vapor outlet; a liquid collection volume; a phase separation matrix including: a first fluid path fluidically coupled between the first inlet and the liquid collection volume; a second fluid path fluidically coupled between the second inlet and the liquid collection volume; and a third fluid path fluidically coupled between the vapor outlet and the liquid collection volume, wherein the phase separation matrix is configured to radially distribute thermal mixing of a refrigerant flowing within the first, second, and third fluid paths.

Example 2: The flash tank of example 1, wherein the phase separation matrix comprises a gyroid.

Example 3: The flash tank of example 1 or example 2, wherein the phase separation matrix is configured to separate the refrigerant into a vapor phase and a liquid phase of both the superheated vapor refrigerant and the two-phase refrigerant, wherein the phase separation matrix is configured to allow the vapor phase to flow through the third path to the vapor outlet, wherein the liquid collection volume is configured to collect the liquid phase from the phase separation matrix.

Example 4: The flash tank of any one of examples 1 through 3, wherein the phase separation matrix comprises a thermally conductive material.

Example 5: The flash tank of any one of examples 1 through 4, wherein the flash tank is configured to have a first pressure at the first inlet that is greater than a pressure of the liquid collection volume, a second pressure at the second inlet that is greater than the pressure of the liquid collection volume, and a third pressure at the vapor outlet that is less than the pressure of the liquid collection volume.

Example 6: The flash tank of example 5, wherein a difference in pressure between the vapor outlet and the liquid collection volume is less than both a difference in pressure between the first inlet and the liquid collection volume and a difference in pressure between the second inlet and the liquid collection volume.

Example 7: The flash tank of example 6, wherein the third fluid path comprises a greater flow volume than both the first fluid path and the second fluid path.

Example 8: The flash tank of any one of examples 1 through 7, further comprising a first distribution manifold configured to radially distribute the superheated vapor refrigerant from the first inlet to the first fluid path and a second distribution manifold configured to radially distribute the two-phase refrigerant from the second inlet to the second fluid path.

Example 9: The flash tank of any one of examples 1 through 8, wherein the phase separation matrix is configured to physically separate fluids flowing the first fluid path, the second fluid path, and the third fluid path such that fluids flowing in one of the first fluid path, the second fluid path, and the third fluid path do not physically mix with fluids flowing in one other of the first fluid path, the second fluid path, or the third fluid path.

Example 10: A system including: a subcooler/super-heater; and a flash tank including: an inlet configured to receive a superheated vapor refrigerant and a two-phase refrigerant; a vapor outlet; a liquid collection volume; a phase separation matrix disposed between the vapor outlet and the liquid collection volume, wherein the inlet is fluidically coupled to the liquid collection volume, wherein the phase separation matrix is configured to separate a vapor phase and a liquid phase of both the superheated vapor refrigerant and the two-phase refrigerant, wherein the sub-cooler/super-heater is fluidically coupled the vapor outlet.

Example 11: The system of example 10, wherein the phase separation matrix is configured to allow the liquid phase to flow to the liquid collection volume and the vapor phase to flow to the vapor outlet.

Example 12: The system of example 10 or example 11, further comprising an expansion valve fluidically coupled between the vapor outlet and an inlet of the subcooler/super-heater.

Example 13: The system of any one of examples 10 through 12, wherein the phase separation matrix comprises a plurality of stacked fins.

Example 14: The system of example 13, wherein the plurality of stacked fins comprise a thermally conductive material.

Example 15: The system of example 13 or example 14, wherein the plurality of stacked fins comprise alternating flat plates and fins brazed together as a block.

Example 16: The system of any one of examples 10 through 15, wherein the inlet comprises a first inlet configured to receive the superheated vapor refrigerant and a second inlet configured to receive the two-phase refrigerant, wherein the phase separation matrix comprises: a first fluid path fluidically coupled between the first inlet and the liquid collection volume; a second fluid path fluidically coupled between the second inlet and the liquid collection volume; and a third fluid path fluidically coupled between the vapor outlet and the liquid collection volume, wherein the phase separation matrix is configured to radially distribute thermal mixing of the refrigerant flowing within the first, second, and third fluid paths.

Example 17: The system of example 16, wherein the flash tank further comprises a first distribution manifold configured to radially distribute the superheated vapor refrigerant from the first inlet to the first fluid path and a second distribution manifold configured to radially distribute the two-phase refrigerant from the second inlet to the second fluid path.

Example 18: The system of example 16 or example 17, wherein the phase separation matrix is configured to physically separate fluids flowing the first fluid path, the second fluid path, and the third fluid path such that fluids flowing in one of the first fluid path, the second fluid path, and the third fluid path do not physically mix with fluids flowing in one other of the first fluid path, the second fluid path, or the third fluid path.

Example 19: A system including: a flash tank downstream of a heat load to be cooled, the flash tank including: an inlet configured to receive a superheated vapor refrigerant and a two-phase refrigerant; a vapor outlet; a liquid collection volume; a phase separation matrix disposed between the vapor outlet and the liquid collection volume, wherein the phase separation matrix is configured to separate a vapor phase and a liquid phase of both the superheated vapor refrigerant and the two-phase refrigerant; within the first, second, and third fluid paths; a subcooler/super-heater downstream of the flash tank; a compressor downstream of the subcooler/super-heater; a condenser downstream of the compressor and upstream of the flash tank; an expansion valve intermediate the flash tank and the subcooler/super-heater, the expansion valve configured to discharge a mixture of vapor and liquid refrigerant to the subcooler/super-heater.

Example 20: The system of example 19, wherein the inlet comprises a first inlet configured to receive the superheated vapor refrigerant and a second inlet configured to receive the two-phase refrigerant, wherein the phase separation matrix comprises: a first fluid path fluidically coupled between the first inlet and the liquid collection volume; a second fluid path fluidically coupled between the second inlet and the liquid collection volume; and a third fluid path fluidically coupled between the vapor outlet and the liquid collection volume, wherein the phase separation matrix is configured to radially distribute thermal mixing of the refrigerant flowing within the first, second, and third fluid paths.

It is to be recognized that depending on the example, certain acts or events of any of the techniques described herein can be performed in a different sequence, may be added, merged, or left out altogether (e.g., not all described acts or events are necessary for the practice of the techniques). Moreover, in certain examples, acts or events may be performed concurrently, e.g., through multi-threaded processing, interrupt processing, or multiple processors, rather than sequentially.

Based upon the above discussion and illustrations, it is recognized that various modifications and changes may be made to the disclosed technology in a manner that does not necessarily require strict adherence to the examples and applications illustrated and described herein. Such modifications do not depart from the true spirit and scope of various aspects of the disclosure, including aspects set forth in the claims.

Various examples have been described. These and other examples are within the scope of the following claims.

What is claimed is:

1. A flash tank comprising:

a first inlet configured to receive a superheated vapor refrigerant;

a second inlet configured to receive a two-phase refrigerant;

a vapor outlet;

a liquid collection volume;

a phase separation matrix comprising:

a first fluid path fluidically coupled between the first inlet and the liquid collection volume;

a second fluid path fluidically coupled between the second inlet and the liquid collection volume; and a third fluid path fluidically coupled between the vapor outlet and the liquid collection volume, wherein the phase separation matrix is configured to radially distribute thermal mixing of a refrigerant flowing within the first, second, and third fluid paths, and wherein the phase separation matrix is configured to physically separate fluids flowing within the first fluid path, the second fluid path, and the third fluid path such that fluids flowing within one of the first fluid path, the second fluid path, and the third fluid path do not physically mix with fluids flowing in one other of the first fluid path, the second fluid path, or the third fluid path.

2. The flash tank of claim 1, wherein the phase separation matrix comprises a gyroid.

3. The flash tank of claim 1, wherein the phase separation matrix is configured to separate the refrigerant into a vapor phase and a liquid phase of both the superheated vapor refrigerant and the two-phase refrigerant, wherein the phase separation matrix is configured to allow the vapor phase to flow through the third path to the vapor outlet, wherein the liquid collection volume is configured to collect the liquid phase from the phase separation matrix.

4. The flash tank of claim 1, wherein the phase separation matrix comprises a thermally conductive material.

5. The flash tank of claim 1, wherein the flash tank is configured to have a first pressure at the first inlet that is greater than a pressure of the liquid collection volume, a second pressure at the second inlet that is greater than the pressure of the liquid collection volume, and a third pressure at the vapor outlet that is less than the pressure of the liquid collection volume.

6. The flash tank of claim 5, wherein a difference in pressure between the vapor outlet and the liquid collection volume is less than both a difference in pressure between the first inlet and the liquid collection volume and a difference in pressure between the second inlet and the liquid collection volume.

7. The flash tank of claim 6, wherein the third fluid path comprises a greater flow volume than both the first fluid path and the second fluid path.

8. The flash tank of claim 1, further comprising a first distribution manifold configured to radially distribute the superheated vapor refrigerant from the first inlet to the first fluid path and a second distribution manifold configured to radially distribute the two-phase refrigerant from the second inlet to the second fluid path.

9. A system comprising:

a subcooler/super-heater; and a flash tank comprising:

an inlet configured to receive a superheated vapor refrigerant and a two-phase refrigerant;

a vapor outlet;

a liquid collection volume;

a phase separation matrix disposed between the vapor outlet and the liquid collection volume, wherein the phase separation matrix defines a first fluid path, a second fluid path, and a third fluid path, wherein the inlet is fluidically coupled to the liquid collection volume, wherein the phase separation matrix is configured to separate a vapor phase and a liquid phase of both the superheated vapor refrigerant and the two-phase refrigerant, wherein the subcooler/super-heater is fluidically coupled the vapor outlet, and wherein the phase separation matrix is configured to physically separate fluids flowing within the first fluid path, the second fluid path, and the third fluid path such that fluids flowing in one of the first fluid path, the second fluid path, and the third fluid path do not physically mix with fluids flowing in one other of the first fluid path, the second fluid path, or the third fluid path.

10. The system of claim 9, wherein the phase separation matrix is configured to allow the liquid phase to flow to the liquid collection volume and the vapor phase to flow to the vapor outlet.

11. The system of claim 9, further comprising an expansion valve fluidically coupled between the vapor outlet and an inlet of the subcooler/super-heater.

12. The system of claim 9, wherein the phase separation matrix comprises a plurality of stacked fins.

13. The system of claim 12, wherein the plurality of stacked fins comprise a thermally conductive material.

14. The system of claim 12, wherein the plurality of stacked fins comprise alternating flat plates and fins brazed together as a block.

15. The system of claim 9, wherein the inlet comprises a first inlet configured to receive the superheated vapor refrigerant and a second inlet configured to receive the two-phase refrigerant, wherein:

the first fluid path is fluidically coupled between the first inlet and the liquid collection volume;

the second fluid path is fluidically coupled between the second inlet and the liquid collection volume; and the third fluid path is fluidically coupled between the vapor outlet and the liquid collection volume, wherein the phase separation matrix is configured to radially distribute thermal mixing of the refrigerant flowing within the first, second, and third fluid paths.

16. The system of claim 15, wherein the flash tank further comprises a first distribution manifold configured to radially distribute the superheated vapor refrigerant from the first inlet to the first fluid path and a second distribution manifold configured to radially distribute the two-phase refrigerant from the second inlet to the second fluid path.

17. A system comprising:

a flash tank downstream of a heat load to be cooled, the flash tank comprising:

an inlet configured to receive a superheated vapor refrigerant and a two-phase refrigerant;

a vapor outlet;

a liquid collection volume;

a phase separation matrix disposed between the vapor outlet and the liquid collection volume, wherein the phase separation matrix is configured to separate a vapor phase and a liquid phase of both the superheated vapor refrigerant and the two-phase refrigerant, wherein the phase separation matrix is configured to physically separate fluids flowing within a plurality of different flow paths within the phase separation matrix such that fluids flowing within each flow path of the plurality of flow paths do not physically mix with fluids flowing in the other flow paths of the plurality of flow paths;

a subcooler/super-heater downstream of the flash tank;

a compressor downstream of the subcooler/super-heater;

a condenser downstream of the compressor and upstream of the flash tank;

an expansion valve intermediate the flash tank and the subcooler/super-heater, the expansion valve configured to discharge a mixture of vapor and liquid refrigerant to the subcooler/super-heater.

18. The system of claim 17, wherein the inlet comprises a first inlet configured to receive the superheated vapor refrigerant and a second inlet configured to receive the two-phase refrigerant, wherein the phase separation matrix comprises:

a first fluid path fluidically coupled between the first inlet and the liquid collection volume;

a second fluid path fluidically coupled between the second inlet and the liquid collection volume; and a third fluid path fluidically coupled between the vapor outlet and the liquid collection volume, wherein the phase separation matrix is configured to radially distribute thermal mixing of the refrigerant flowing within the first, second, and third fluid paths.

* * * * *